US008002931B2

(12) United States Patent
Wang et al.

(10) Patent No.: US 8,002,931 B2
(45) Date of Patent: Aug. 23, 2011

(54) 360 DEGREE MUG WRAP

(75) Inventors: Dexian Wang, Beijing (CN); James Peng, Cupertino, CA (US)

(73) Assignee: Photo USA Corp., Sunnyvale, CA (US)

( * ) Notice: Subject to any disclaimer, the term of this patent is extended or adjusted under 35 U.S.C. 154(b) by 184 days.

(21) Appl. No.: 11/701,828

(22) Filed: Feb. 2, 2007

(65) Prior Publication Data

US 2010/0015368 A1 Jan. 21, 2010

(30) Foreign Application Priority Data

Apr. 25, 2006 (CN) ..... 2006 2 0112962 U

(51) Int. Cl.

| | |
|---|---|
| ***B29C 63/04*** | (2006.01) |
| ***B29C 63/20*** | (2006.01) |
| ***B29C 65/02*** | (2006.01) |
| ***B29C 65/48*** | (2006.01) |
| ***B29C 65/78*** | (2006.01) |
| ***B32B 37/02*** | (2006.01) |
| ***B32B 37/10*** | (2006.01) |
| ***B32B 37/12*** | (2006.01) |
| ***B32B 38/14*** | (2006.01) |
| ***B44C 1/17*** | (2006.01) |
| ***B44C 1/24*** | (2006.01) |
| *B29C 65/72* | (2006.01) |
| *B32B 37/14* | (2006.01) |
| *B44C 3/08* | (2006.01) |

(52) U.S. Cl. ..... 156/240; 156/213; 156/229; 156/230; 156/232

(58) Field of Classification Search .... 156/DIG. 8–DIG. 13, 213, 229, 230–249
See application file for complete search history.

(56) References Cited

U.S. PATENT DOCUMENTS

| | | | | |
|---|---|---|---|---|
| 3,816,221 | A | 6/1974 | Shank, Jr. | |
| 4,658,721 | A * | 4/1987 | Mathis | 101/9 |
| 4,874,454 | A | 10/1989 | Talalay et al. | |
| 4,989,508 | A * | 2/1991 | King | 101/35 |
| 5,019,193 | A | 5/1991 | Aramini | |
| 5,170,704 | A | 12/1992 | Warren et al. | |
| 5,244,529 | A * | 9/1993 | Siegel | 156/384 |
| 5,296,081 | A | 3/1994 | Morin et al. | |
| 5,318,842 | A | 6/1994 | Ogale | |
| 5,318,942 | A * | 6/1994 | Laudy | 503/227 |

(Continued)

OTHER PUBLICATIONS

"friction", http://www.thefreedictionary.com/friction.*
"traverse", http://www.thefreedictionary.com/traverse.*
Mug Press, Operator's Manual, Heat Transfer Equipment.

*Primary Examiner* — Sonya Mazumdar
(74) *Attorney, Agent, or Firm* — Stetina Brunda Garred & Brucker; Lowell Anderson

(57) ABSTRACT

A method and apparatus are provided for of applying a sublimation transfer to a coffee cup having a handle connected at two locations to the cup. A sublimation transfer is placed around the container with a dye image an outer surface of the cup and extending beneath the handle. An elastic clamp wraps around the cup and sublimation transfer and extends beneath the handle to press the dye layer against the cup beneath the handle. The clamp has an elongated opening near one end of the clamp and the opening is placed over the handle to fasten the clamp to the cup. The wrapped cup and sublimation transfer is placed on a conveyor oven for sublimation heating, with the clamp being removed for reuse after the sublimation transfer of the dye layer onto the cup is completed.

22 Claims, 15 Drawing Sheets

U.S. PATENT DOCUMENTS 5,382,313 A 1/1995 Eminger
5,395,478 A * 3/1995 Sattler et al. ..... 156/481
5,584,961 A 12/1996 Ellsworth et al.
5,630,894 A 5/1997 Koch et al.
5,755,921 A * 5/1998 Christensen ..... 156/391
5,944,931 A * 8/1999 Cranford ..... 156/230
5,948,728 A * 9/1999 Patton et al. ..... 503/227
5,962,368 A * 10/1999 Poole ..... 503/227

* cited by examiner 38a
30
32
29
24
34

40b
28a
10
32
28b
40b
40a
36
38b

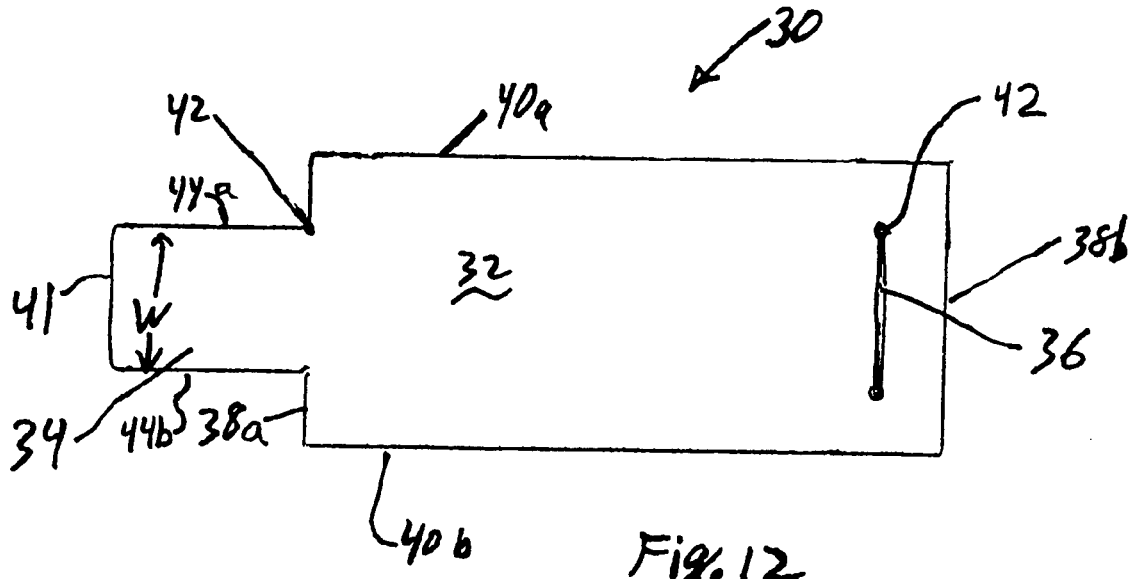
Fig. 12
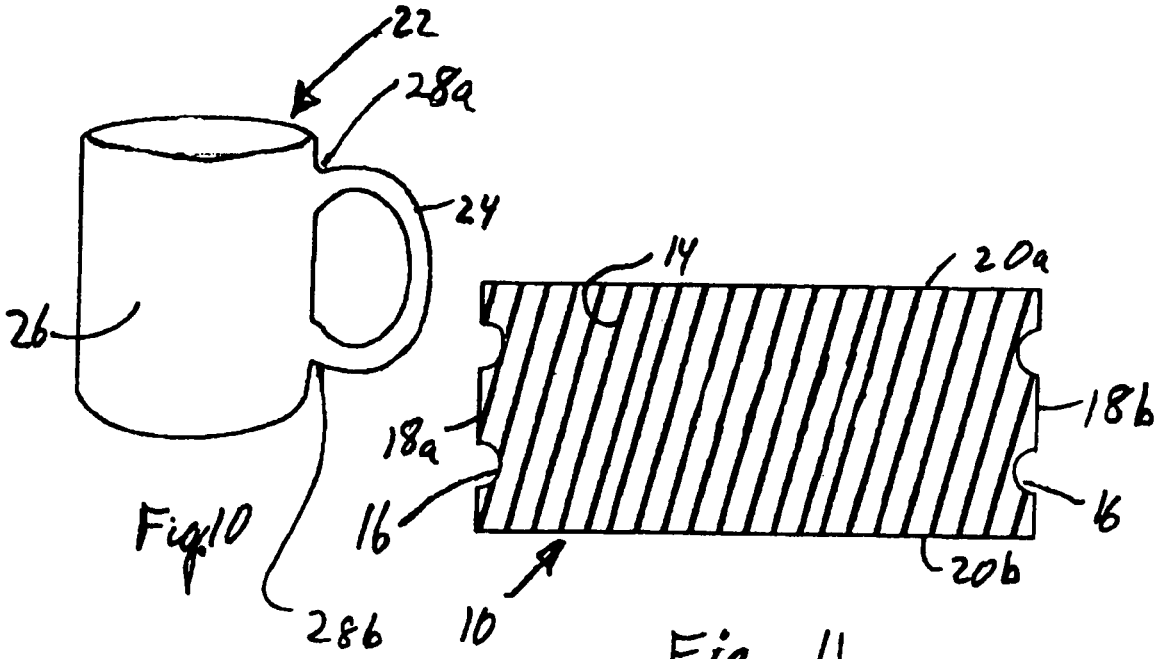
Fig. 10
Fig. 11

38a
36a
54
54
40a
36b
40b
38b 22
24
36a
38a
10
54
40a
16b
40b
38b 38b
36b
40b
40a
54
54
38a
38a 38b
54
38b
26b

360 DEGREE MUG WRAP

BACKGROUND

The present invention relates generally to the field of sublimation transfers, and more particularly to an improved method and apparatus for applying heat transferable decals to shaped containers or other similar articles having a handle, such as mugs or cups.

To decorate a mug a sublimation transfer is placed in direct contact with a mug which has been coated with a polymeric coating. A device presses part of the sublimation transfer against the mug. The mug is then heated to a temperature at least as high as sublimation temperature of the dyes constituting the image to be printed. The dies vaporize and their immediate absorption into the polymeric coating on the mug transfers the image from the sublimation transfer to the mug.

But the prior sublimation methods and apparatus suffer from the disadvantage of being unable to print an image or design on the entire outer surface of a mug when the mug includes a handle. More particularly, the prior art techniques and equipment cannot print around or under the handle of a mug, because the handle itself precludes conventional sublimation transfers and cuffs from being applied around and under the handle.

Further, when the cups or mugs are not cylindrical tubes with vertical walls, but are instead tapered cups with wider or narrow bottoms than the tops, the sublimation equipment does not apply a sufficient or uniform pressure to work properly, and the sublimation transfers leave an even larger gap of unprinted material in the area of the handle.

Moreover, sublimation layers are typically applied one at a time by placing the mug and sublimation layer into a press that is specially configured for a specific mug, and that compresses the layer against the mug—one at a time.

There is thus a need for an improved way to apply sublimation transfers to containers, and a need for containers with sublimation transfer images around the entire circumference of the mug, including beneath the handles.

BRIEF SUMMARY

A method and apparatus are provided for of applying a sublimation transfer to a coffee cup having a handle connected at two locations to the cup. A sublimation transfer is placed around the container with a dye image an outer surface of the cup and extending beneath the handle. An elastic clamp wraps around the cup and sublimation transfer and extends beneath the handle to press the dye layer against the cup beneath the handle. The clamp has an elongated opening near one end of the clamp and the opening is placed over the handle to fasten the clamp to the cup. The wrapped cup and sublimation transfer is placed on a conveyor oven or other heating device for sublimation heating, with the clamp being removed for reuse after the sublimation transfer of the dye layer onto the cup is completed.

It is therefore an object of the present invention to provide an improved method and apparatus for printing sublimation transfers on cone-shaped containers with handles, such as mugs and cups.

A further object of the present invention is to provide an improved method of printing sublimation transfers on containers with handles, wherein the printing can be achieved on the entire outer surface of the container including the area around and under the handle.

Another object of the instant invention is to provide an improved method of printing sublimation transfers on cone-shaped mugs with handles, which method results in a more aesthetically pleasing mug as compared to prior art printing methods Yet another object of the instant invention is to provide an improved sublimation transfer which enables printing on the entire outer surface of a cone-shaped container without interference from the handle, including the area around and under the handle.

A further object of the invention is to provide an improved clamp apparatus, preferably (but optionally) made of an elastomeric material such as silicon, suitable for applying a uniform pressure to the surface of the cup, and preferably (but optionally) having a long cut-out strip for use when printing a sublimation transfer on a cone-shaped container with a handle, which clamp apparatus can be used to uniformly press a sublimation transfer against the entire outer surface of a container regardless of the size shape or location of the container handle, and which is especially useful with a cone-shaped container.

Another object of the invention is to provide an improved method and apparatus which can quickly, easily and inexpensively produce custom printing on containers with handles, such as cups and mugs, and which is especially useful with on cone-shaped.

These and other objects and advantages are achieved by the present method and apparatus which provides an improved method of applying a sublimation transfer to a container having a handle, such as a cup or mug, where the mug has various shapes or surface configurations, including cone-shaped mugs, and wherein the handle is optionally connected to the container at least at one connection area on the outer surface of the container. The method includes providing a sublimation transfer having a length which enables the sublimation transfer to completely encircle the outer surface of the container, even a cone-shaped container. The sublimation transfer includes at least one cut-out strip that has a shape which is generally complimentary to the shape of the handle connection area and enables the sublimation transfer to encircle or surround the handle connection area. The sublimation transfer is resiliently pressed against the container using a resilient and conformable clamp and heat is applied to the sublimation transfer and clamp to cause printing on the container. The method enables the printing to completely encircle the handle connection areas, thereby enabling printing on the entire visible outer surface of the container, including the area around and under the handle itself, even on tapered cups and mugs.

In accordance with a more particular aspect of the sublimation transfer, a long cut-out strip is provided to fix the sublimation transfer securely through buttoning to the handle of the container, wherein two opposing ends of the strip enable the sublimation transfer to encircle each handle connection area when placed on the container, so that the cut-out strip can encircle the cone-shaped container in 360 degree without interspaces. The sublimation transfer is optionally shaped to conform to the surface to which die is to be transferred, so that, for example, the transfer is generally rectangular for a cylindrical mug and of sufficient length that the ends abut or overlap, and the transfer is generally arc-shaped or fan-shaped for mugs with sides tapered at a constant angle and of sufficient length that the ends of the transfer abut or overlap.

In accordance with yet another aspect of the invention, an improved silicon clamp is provided for use during printing of a sublimation transfer on a container with a handle, such as a cup or mug, whether the container has vertical sides or whether the container is cone-shaped or of other shape. The clamp is of a generally long and expandable strip adapted to encircle the container and press a sublimation transfer against the outer surface thereof. An elastic material, preferably but optionally of silicon, is preferred for use with the clamp. The clamp has a first width corresponding to or optionally greater than a width of the sublimation transfer and extending for a length of the clamp corresponding to or slightly smaller than a circumference of the mug, and a second width at a distal end having at least a portion that is smaller than the first width and preferably, but optionally corresponds to a distance between the attachment of the handle to the cup. The clamp further, and optionally, includes one cut-out strip in the first width of the clamp body with the distal end threaded through the cut-out strip so the clamp body encircles the handle connection area when placed around the cone-shaped container and the distal end is threaded through the cut-out strip. The elastic clamp is stretched enough to apply pressure to substantially the entire outer surface of the container, thereby resiliently urging the sublimation transfer against the surface of the mug and assisting in printing a sublimation transfer on the entire outer surface of a cone-shaped container, including the area around and under the handle.

There is thus advantageously provided a method of applying a sublimation transfer to a container having a periphery with a handle, wherein the handle is connected to the container at least at one connection area on the outer surface of the container and extends along a portion of the container. The outer surface of the container coated with a polymeric coating. The method includes the steps of placing a sublimation transfer around the container with a dye image of the sublimation transfer facing an outer surface of the container. An elastic clamp is then provided where the clamp comprises a sheet of material with a first and second end joined by opposing sides and forming a body portion which is larger than the outer surface of the container when the clamp wraps around the container. The clamp has at least one elongated opening adjacent one of the ends which opening is configured to allow the handle to pass through the opening. The clamp is wrapped around the entire periphery of the outer surface of the container but beneath the handle and the clamp is stretched along a length of the clamp an amount sufficient to cause the clamp to presses the dye image inward against the outer surface of the container with a force sufficient to allow a sublimation transfer. The opening in the clamp is placed over the handle or the free end of the clamp is otherwise secured to the assembly. The assembly is then ready for heating by applying heat to the wrapped sublimation transfer sufficient to cause a sublimation transfer of the dye image to the container.

In further variations, the method further includes fastening the first end of the clamp to at least one of the sublimation transfer, the clamp or the container before the wrapping step, and fastening the second end of the clamp to one of the clamp or the container.

The step of placing the opening over the handle preferably occurs after the wrapping step and fastens the second end to the container, but the step of placing the opening over the handle could occur before the wrapping step. In a further variation, the clamp comprises a body portion having a first width and a latching portion extending from the first end of the body portion with the opening located by the second end. In this further variation the wrapping step includes placing the latching portion beneath the handle and between the sublimation transfer and the clamp. In a still further variation, the body portion preferably comprises a rectangle which is especially suitable for use with containers having parallel sides. For containers having inclined sides, the body portion preferably comprises a segment of an arc having first and second opposing sides that are generally concentric. For these arc-shaped segments the latching portion advantageously, but optionally, also comprises a segment of an arc having first and second opposing sides that are generally concentric.

In a still further variation, the method includes providing stress relief openings at least at one of either the juncture of the latching portion and the body portion or the on the opening. Advantageously, the handle fastens to the container at two locations and the latching portion passes between those locations and beneath the handle. Preferably, the first end is held between the sublimation transfer and the clamp. Preferably, the sublimation transfer has two ends which are placed in a contacting or very close to contacting position beneath the handle before the wrapping step. In still further variations, the wrapping step causes the clamp to encircle the outer surface of the container at least two times.

The heat is preferably applied to the wrapped sublimation transfer by placing the wrapped sublimation transfer on a conveyor of a conveyor oven, moving the convey and wrapped sublimation transfer into the conveyor oven, keeping the wrapped sublimation transfer in the oven a time sufficient to cause the sublimation transfer of the dye image to the container, and moving the conveyor and wrapped sublimation transfer from the oven. After heating, the clamp and sublimation transfer are removed.

There is also advantageously provided a sublimation transfer assembly including a container having an outer surface coated with a polymeric coating to receive a sublimation transfer image. The container has a handle connected to the outer surface at least at one location, and preferably at two locations. A sublimation transfer is provided having a dye layer placed against the outer surface of the container. The sublimation transfer has opposing ends placed immediately adjacent each other or in contact with each other beneath the handle, at least one end of the sublimation transfer has at least one recess located and is configured to encircle a portion of the handle as the handle connects to the container.

The assembly also includes an elastic body portion having first and second opposing ends and first and second opposing sides with an elongated opening adjacent to and extending along the second end. The elastic body is stretched and wrapped around the sublimation transfer and beneath the handle with the elongated opening preferably fitting over the handle to hold the second end in position relative to the container. The distance between the first and second sides of the body portion are greater than the distance between the top and bottom of the sublimation transfer and the elastic body portion thus covering all of the sublimation transfer and stretched sufficiently to urge the dye layer against the outer surface of the container with sufficient pressure to allow a sublimation transfer on the outer surface of the container.

Where the handle connects to the container at two locations, the sublimation transfer preferably has two recesses, each recess encircling a portion of the location at which the handle connects to the container. For a mug with tapered sides and a handle that connects to the mug at two locations, and for these mugs the body portion preferably has a fan shape with the distance between the sides of the body portion being larger than the distance between the top and bottom of the mug. For the tapered mugs, the assembly preferably includes a latching portion extending from the first end of the body portion along an arc, with the latching portion extending between the two locations at which the handle connects to the mug and beneath the handle and with the latching portion abutting the sublimation transfer.

Where the container is a mug with parallel sides and a handle that connects to the mug at two locations, then the body portion preferably has a rectangular shape with the distance between the sides of the body portion being larger than the distance between the top and bottom of the mug. Further, there is preferably a latching portion extending from the first end of the body portion and generally perpendicular to the first end and with the latching portion extending between the two locations at which the handle connects to the mug and beneath the handle. The latching portion abuts the sublimation transfer.

There is also advantageously provided a clamp for use with a sublimation transfer process for a liquid container having an outer surface coated with a polymeric coating to receive a sublimation transfer image from a sublimation transfer placed against the outer surface. The container has a handle connected to the outer surface at two locations between a top and bottom of the container. The clamp includes an elastic body portion having first and second opposing ends and first and second opposing sides with an elongated opening adjacent to and extending along the second end. The elongated opening is sized and located to fit over the handle during use of the clamp. The distance between the first and second sides is greater than the distance between the top and bottom of the container. The distance between the first end and the elongated slot is less than a circumference of the container at the corresponding location of the container when the clamp is placed on the container during use.

In further variations of this clamp, an elongated latching member extends from the first end of the body portion, with the latching member sized to fit below the handle and extend between the two locations joining the handle to the container. The body portion body portion can have a fan shape with the distance between the sides of the body portion being larger than the distance between the top and bottom of the mug and wherein the elongated latching member extends along an arc. This curved body portion is advantageously used with mugs having tapered sides.

In further variations, the body portion has a rectangular shape with the distance between the sides of the body portion being larger than the distance between the top and bottom of the mug and with the latching portion extending generally perpendicularly from the first end. This variation is especially useful with mugs having parallel sides. In the above clamps, there are preferably, but optionally, stress relief openings at the juncture(s) of the elongated latching member and the body portion. The clamp is preferably made of silicon.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 10 is a perspective view of a mug having straight, parallel sides;

FIG. 11 is a plan view of a sublimation transfer for use with the mug of FIG. 10;

FIG. 12 is a plan view of a clamp for use with the mug of FIG. 10;

FIG. 17 is a plan view of a further embodiment of a clamp having a thickened portion and an optional necked portion, with slots in the opposing ends; and FIGS. 18*a*-18*c* are perspective views of the clamp of FIG. 17 applied to a container rand sublimation transfer.

DETAILED DESCRIPTION

Figure 1A:
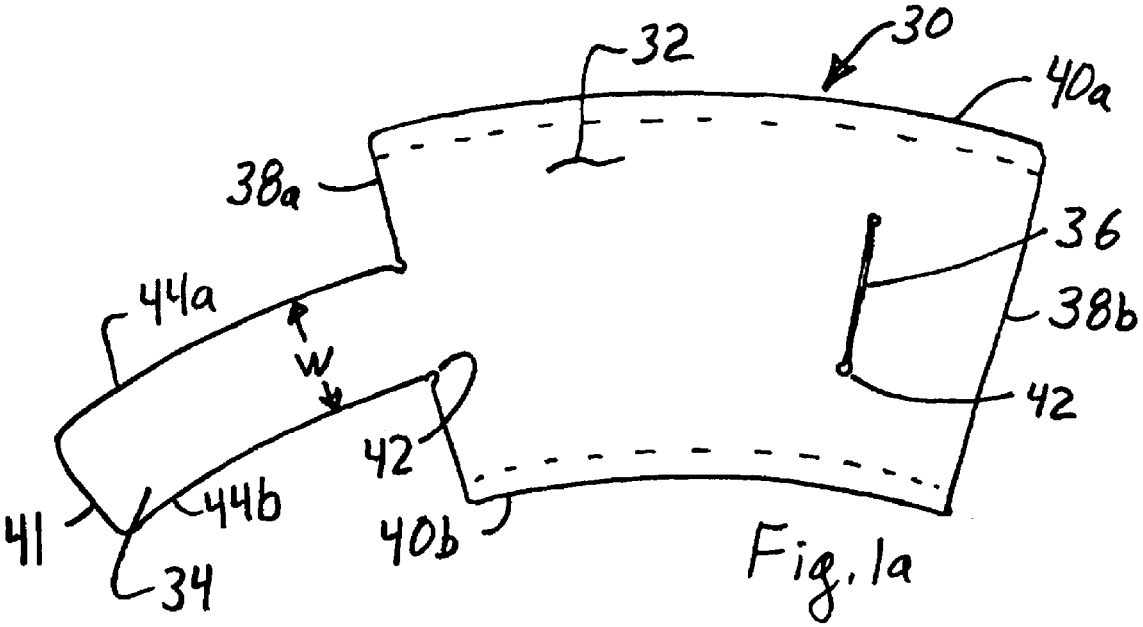
FIG. 1*a* shows a sublimation transfer clamp in accordance with a preferred embodiment of the present invention.
Figure 1B:
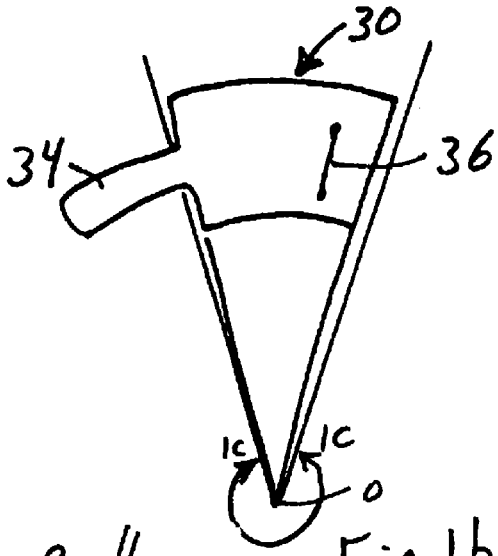
FIG. 1*b* shows the transfer clamp of FIG. 1 with the transfer paper in dashed line having a scallop shape and with the clamp and transfer paper having the same center but with different angles and arc lengths.
Figure 1C:
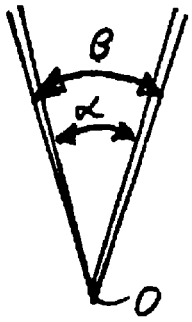
FIG. 1*c* is an angle section view taken from FIG. 1*b;*
Figure 2B:
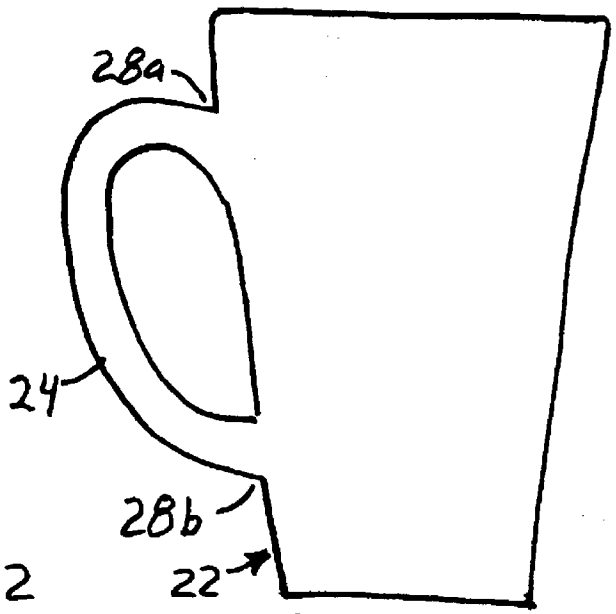
FIG. 2*b* is a front view of the mug of FIG. 2*a* showing the handle, with the back view being a mirror image thereof.
Figure 2C:
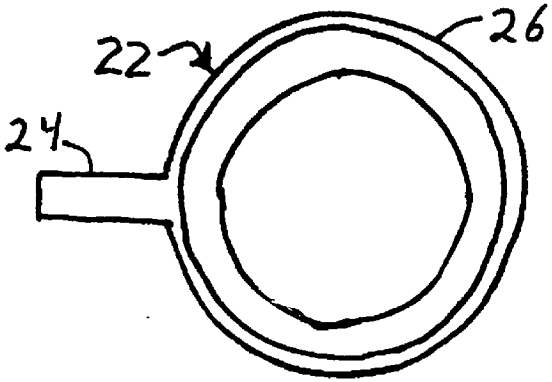
FIG. 2*c* is a top view of the mug of FIG. 2*a*, from three-dimensional, front and top view and the injected paper printed with colorful pictures.
Figure 2A:
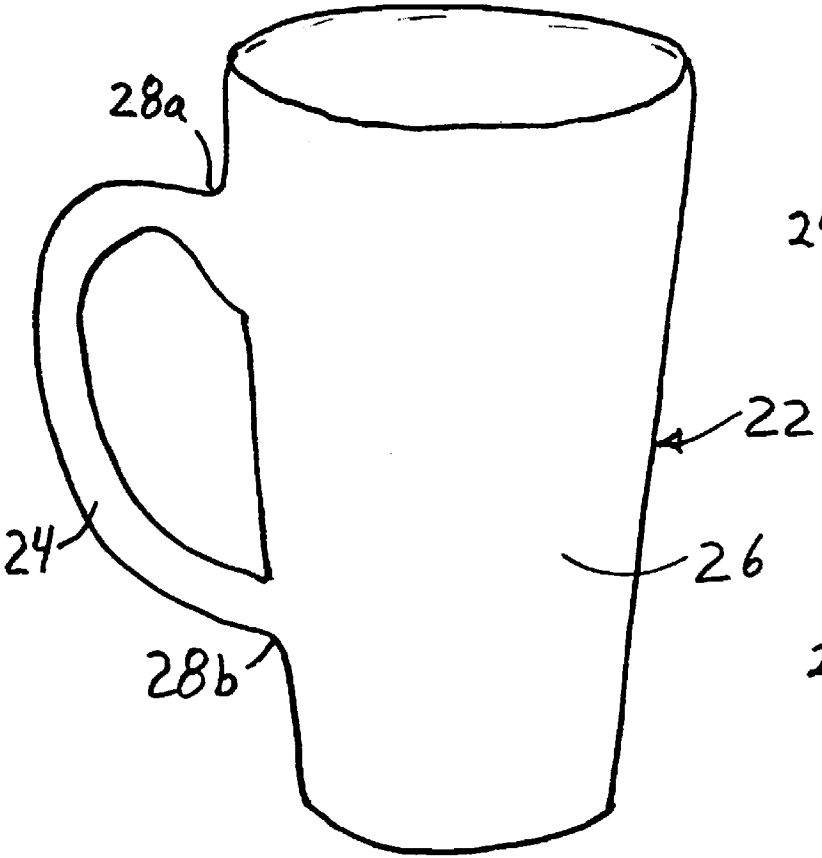
FIG. 2*a* is a perspective view of cone-shaped mug.
Figure 3A:
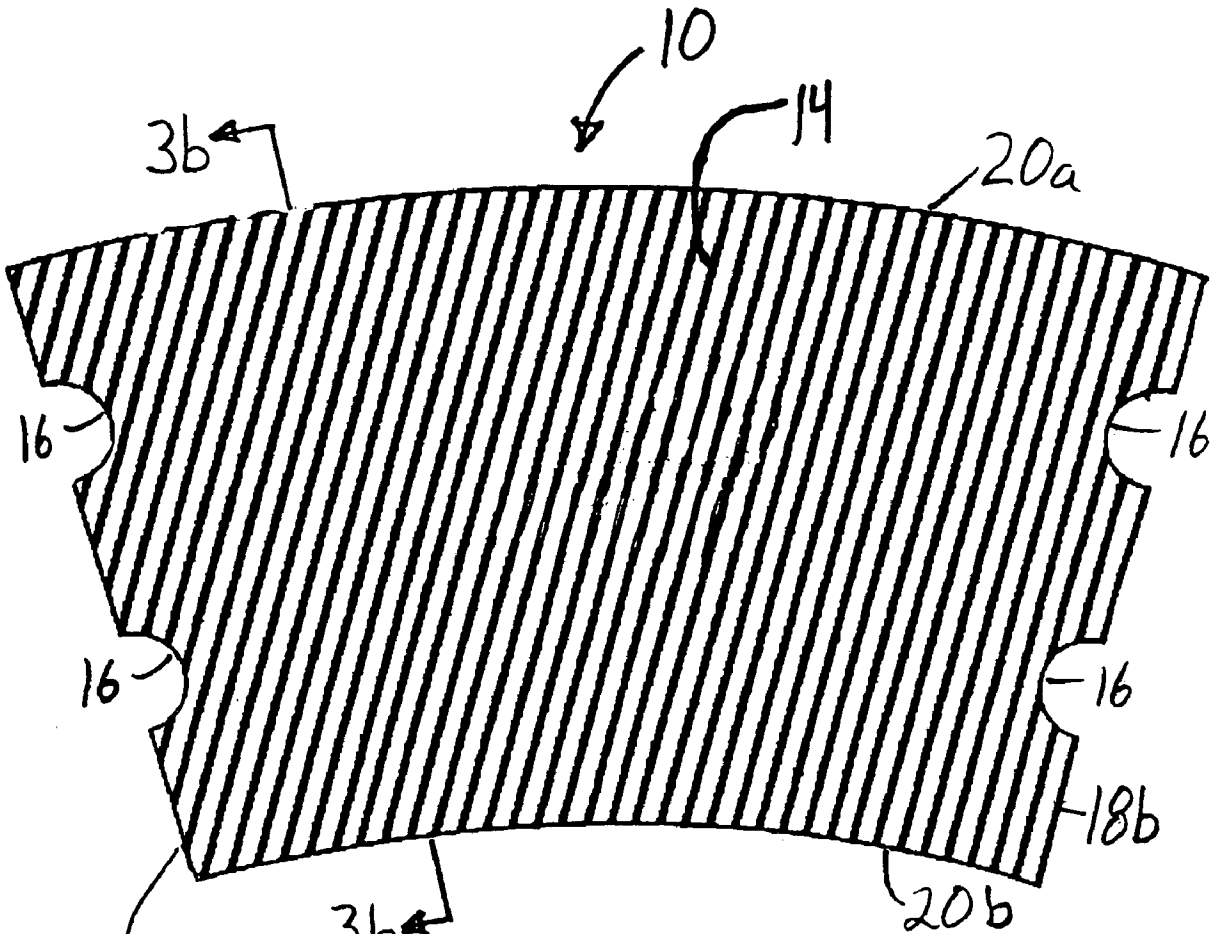
FIG. 3*a* shows injected sublimation transfer paper configured for the corn-shaped mug of FIG. 2*a;*
Figure 3B:
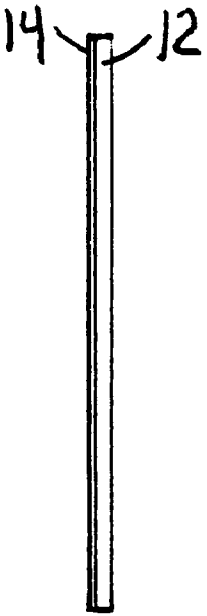
FIG. 3*b* is a sectional view taken along 3*b*-3*b* of FIG. 3*a;*

Referring to FIGS. 1-4, Referring now to the drawings, wherein like reference numerals designate similar parts throughout the various views, and more particularly to FIG. 3 thereof, there is shown a sublimation transfer 10 having at least two parts, a substrate 12 of any suitable material, such as paper, and a sublimable dye image or dye layer 14. The image 14 may be any type of image, design, decoration, text, or the like with which is desired to have printed on an article by sublimation. Inasmuch as sublimable dyes and the sublimation process are generally well know to persons skilled in the art, specific details regarding the substrate 12 and dye image 14 are not further discussed herein.

The sublimation transfer 10 includes a number of shaped recesses 16 extending toward the middle of the transfer from opposing ends of the transfer 10. The recesses 16 in FIG. 3*a* are shows as four small semi-circles, respectively with the shape of the recesses being selected to conform to the periphery of the handle of the mug, as explained more detail below. The recesses 16 small circles are preferably located along opposing ends 18*a*, 18*b* and near one of the sides 20*a*, 20*b*. In the illustrated embodiment, the recesses 16 extend a distance of about 43 mm from the respective edge 18*a*, 18*b*, from the associated ends 18*a*, 18*b* toward an interior of the sublimation transfer 10. The recesses may be formed by any suitable manner, including a cutting, punching or stamping operation.

The sublimation transfer 19 is configured to be placed around a container 22 having a handle 24, such as a cup, mug or any other type of container 12 on which sublimation printing of the image 14 is desired. The illustrated container 22 is tapered or cone-shaped, with a straight, but inclined wall on the container. The sublimation transfer 10 is wrapped around the container 22 with the dye layer containing the image 14 facing inwardly against an outer surface 26 of the container 22. Inwardly here means toward the inside of the container 22. The container 22 shown in FIG. 2 is a common type of mug, such as a ceramic mug, having a typical handle 24 which is generally U-shaped or C-shaped and connects with the mug 22 at two connection points or areas 28*a*, 28*b*. Before placing the sublimation transfer 10 around the container 22, the outer surface 26 of the container is preferably coated with a polymeric coating to facilitate printing.

The sublimation transfer 10 preferably has a length which enables the opposing ends 18*a*, 18*b* to abut against one another, or at least come within close proximity with one another, when the sublimation transfer 10 is wrapped around the container 12. Thus, the length of the sublimation transfer 10 is selected to correspond to the particular size and shape of the container 12. As seen from FIGS. 2*a* and 3*a*, the recesses 16 have a size, shape and location on the sublimation transfer 10 which generally correspond to the size shape and location of the handle 24 at connection areas 28*a*, 28*b*. This feature enables the sublimation transfer 10 to cover the entire outer surface 26 of the container 22. In other words, the cutout recesses 16 preferably have a complementary size and shape to that of the handle 24 at the connection areas 28*a*, 28*b*. This feature enables that sublimation transfer 10 to fit around and under the handle 24, so that ends 18*a*, 18*b* can come very close to each other and advantageously into abutting relationship without interference from the handle 11. This also allows the image 14 on the sublimation transfer 10 to be in contact with the entire outer surface 26 of the container 22, including the portion of the outer surface located around and under the handle 24. The sublimation transfer 10 may sometimes be held in position on the container by merely pressing the dye image 14 against the outer surface 26 of the container 22, using friction, using temporary adhesion between the parts, or using static charges to temporarily hold the parts together. Alternatively, the sublimation transfer 10 may be temporarily held in position on the cup or container 22 by adhesive tape 29 (e.g., FIG. 5).

While four cut-out portions or recesses 16 are shown in the embodiment of FIG. 3*a*, any suitable number of cut-outs can be used depending on the shape of the handle 11 and the manner in which it connects with the container 22. For example, if the handle 24 had only had one connection to the mug 22, only two complementary recesses 16 would be used. In addition, only one end 18*a*, 18*b* could include a recess 16, if the recess was made deep enough to enable the entire handle 24 at the connection locations 28*a*, 28*b* to be received therein. Further, in a less preferred embodiment, the portion between the connection points 28*a*, 28*b* and the adjacent top or bottom of the mug 22, could be configured to not encompass the top or bottom part of the handle, while the ends 18*a*, 18*b* abut beneath the handle 24. There are numerous alternative configurations available for the recesses 16, and any may be used in to enable the sublimation transfer 10 to fit around and encircle the handle 24 at the connection locations 28*a*, 28*b*, so that the sublimation transfer 10 can be in contact with the outer surface 26 of the mug 22 without substantial interference from the handle 24.

Figure 4A:
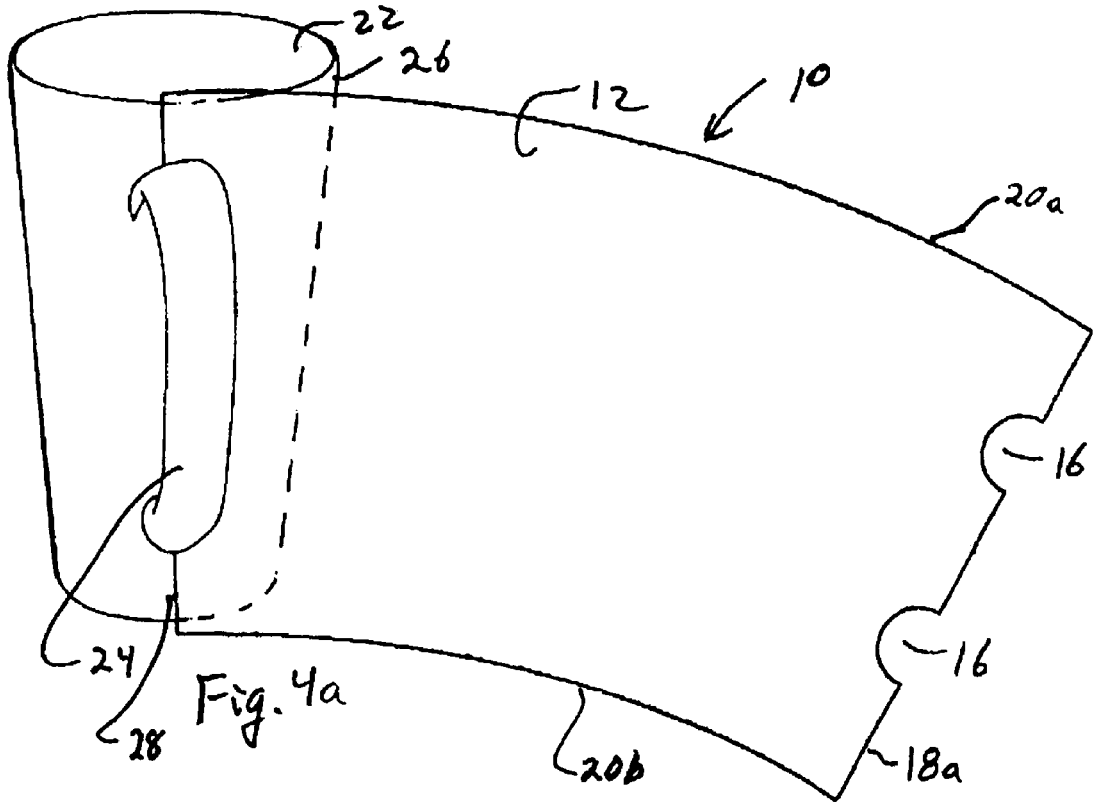
FIGS. 4*a*-4*b* show the injected sublimation transfer paper of FIG. 3 being attached to the cone-shaped mug of FIG. 2*a;*
Figure 4B:
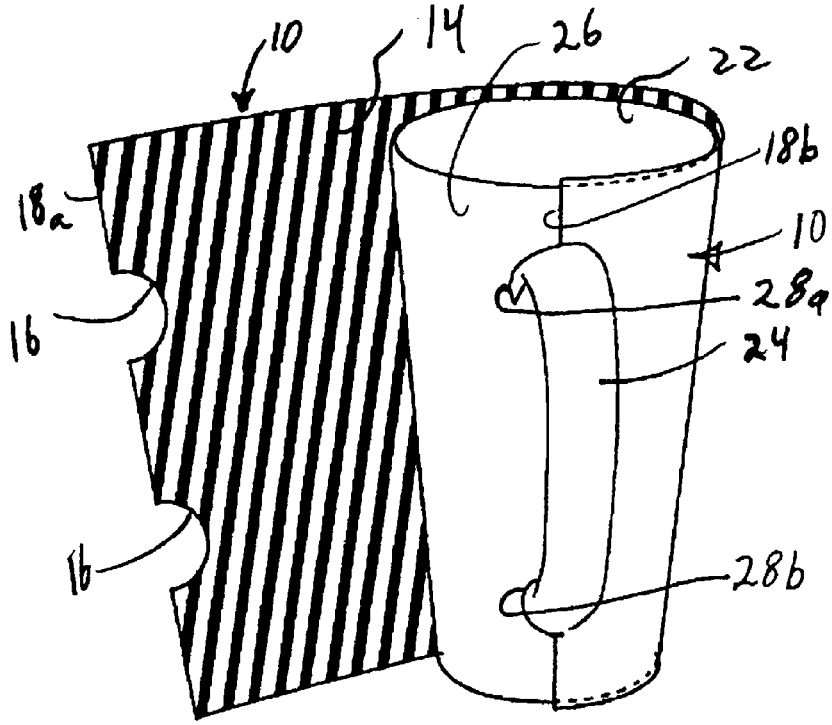

Referring to FIGS. 1, 3 and 4, the illustrated embodiment of the sublimation transfer 1 is configured to be placed around a cone-shaped container 22 having a handle 24 that connects at two locations 28*a*, 28*b*. The sublimation transfer 10 is wrapped around the mug 22 with the dye image 14 facing inwardly toward the outer surface 26 of the container 22. The sublimation transfer 10 preferably has a length which enables the ends 18*a*, 18*b* to abut against one another, or at least come within close proximity with one another, when the sublimation transfer 10 is wrapped around the container 22. Thus, the length of the sublimation transfer 10 is selected to correspond to the particular size and shape of the container 22. For a conical container 22 with the top opening larger than the closed bottom, the circumference around the top of the container is larger than the circumference around the bottom. To make a flat sublimation transfer 10 conform to this tapered and curved (conical) surface 26, the transfer 10 has its top side 20*a* longer than the bottom side 20*b*. By curving the sides 20*a*, 20*b* to form arcs (See e.g., FIGS. 1*b*, 1*c*) and forming ends 18*a*, 18*b* as radial ends of a sub-tended arc, a flat transfer sheet 10 can conform to and substantially cover the outer surface 26. The sides 20*a*, 20*b* form concentric arcs having a common origin "o." The resulting shape with the opposing curved sides 20*a*, 30*b* has a fan-shape and it will be referred to as such herein, recognizing that the shape can vary and still resemble a fan. The recesses 16 allow the transfer 10 to avoid hitting the handle, and to cover the areas not just above and below the handle 24, but also the area beneath the handle 24 and between the recesses 16 on one of the sides 18*a*, 18*b*. Depending on the shape of the container 22, the shape of the sublimation transfer 10 will vary, with the shape of the transfer 10 preferably being selected to cover the surface 26 of the container 10 other than the connection points 28*a*, 28*b* between the handle 24 and container 22. FIGS. 4*a*, 4*b* show how the sublimation transfer 10 is wrapped around the tapered container 22 so the dye image 14 is placed against the outer surface 26 of the container, with the recesses 16 allowing ends 18*a*, 18*b* to abut each other.

Referring now to FIG. 1, an embodiment of clamp 30 is shown for use with the tapered container 22. In use, a portion of the clamp 30 encircles the sublimation transfer 10 and extends beneath or through the handle 24, with the clamp 30 being stretched to urge the transfer 10 against the container 22, and thus releasably hold in position the transfer 10 and ends 18*a*, 18*b* of the transfer 10. The clamp 30 comprises a sheet of elastic material, preferably silicon which can stretch enough to resiliently wrap around the outer surface 26 of the container 22. The clamp 30 has a first portion 32, referred to hereinafter as body portion 32 and has a second latching portion 34, with an opening 36, preferably taking the form of a slit, slot, or cut-out, formed in the body portion. The opening 36 can have various shapes, but is preferably an elongated opening shaped to fit over the handle 24 when stretched (and without tearing), or less desirably, without stretching. Preferably, the distance between the elongated opening 36 and the end 38*a* is less than the circumference of the container 22 for corresponding locations of the container and elongated opening 36, so that the body portion 32 encircles the container 22 one time and is stretched to align the elongated opening with the handle 24.

The body portion 32 preferably, but optionally, conforms to the general shape of sublimation transfer 10. Advantageously the body portion 32 is slightly larger than the transfer 10, and is preferably larger than any dye image 14 on the transfer 10. Because the body portion 32 urges the dye image 14 against the outer surface 26, the body portion 32 is preferably overlaps all of the dye image 14, and to account for misalignments the body portion 32 is preferably larger than the dye image 14. Because the illustrated container 10 is a tapered mug, the clamp body 32 is also curved, for similar reasons discussed in configuring the sublimation transfer 10. The clamp body 32 thus has opposing ends 38*a*, 38*b* and opposing sides 40*a*, 40*b*, with top side 40*a* larger than top side 40*b* and both sides extending along concentric arcs having origin "o." The ends 38*a*, 38*b* extending along radial lines passing through origin "o." The body 10 is slightly wider than the corresponding portion of sublimation transfer 10, preferably about 1 cm larger on the top side 40*a*, bottom side 40*b*, left end 38*a*, and right end 38*b*. The body portion 32 with curved sides 40*a*, 40*b* resembles a fan-shape, and will be referred to as fan-shaped herein, recognizing that the shape can vary.

The elongated opening 36 is preferably located and sized to fit over the handle 24 when the clamp 30 is placed over the container 22—but requires the body to be stretched to do so. For a tapered mug 22, the elongated opening 36 is thus preferably radial, and thus advantageously aligned with and preferably parallel to the ends 38*a*, 38*b*, and on a line passing through origin "o." The elongated opening 36 has a length that is preferably the same as the greatest distance between the connecting locations 28*a*, 28*b*, from the top of the handle 24 to the bottom of the handle. The elongated opening 36 could be smaller if the material of the clamp 30 allows the slit to stretch over the handle without tearing. Advantageously, the elongated opening 36 is long enough that when it stretches over handle 24, the body 32 overlaps any dye image 14 so as to resiliently urge the dye image 14 against the outer surface 26. This is achieved by stretching the body 30 and thereby causing it to squeeze inward toward the container 10 and the intervening sublimation transfer 10.

The latching portion 34 extends from one of the ends 38*a*, 38*b*, and is shown in FIG. 1*a* as extending from the left end 38*a*. The latching portion 34 has a distal end 41 and opposing sides 44*a*, 44*b*. The latching portion 34 has a width "W" and that width W is selected to fit between the connecting locations 28*a*, 28*b* between the container 22 and its handle 24. In this embodiment for a tapered mug 22, the sides 44*a*, 44*b* preferably, but optionally, extend along an arc having origin "o" with end 41 being a radial line passing through origin "o." Stress relief recesses 42 are located as needed to reduce tearing of the clamp 30. Square corners on stretchable material tend to tear, and thus stress relief recess 42 in the form of circles, are located at the juncture between sides 44*a*, 44*a* and the end 38*a*, and also are located at the ends of the elongated opening 36. If elongated opening 36 takes the form of an opening having corners, then stress relief recesses 42 could optionally be located at those corners as well.

Figure 5:
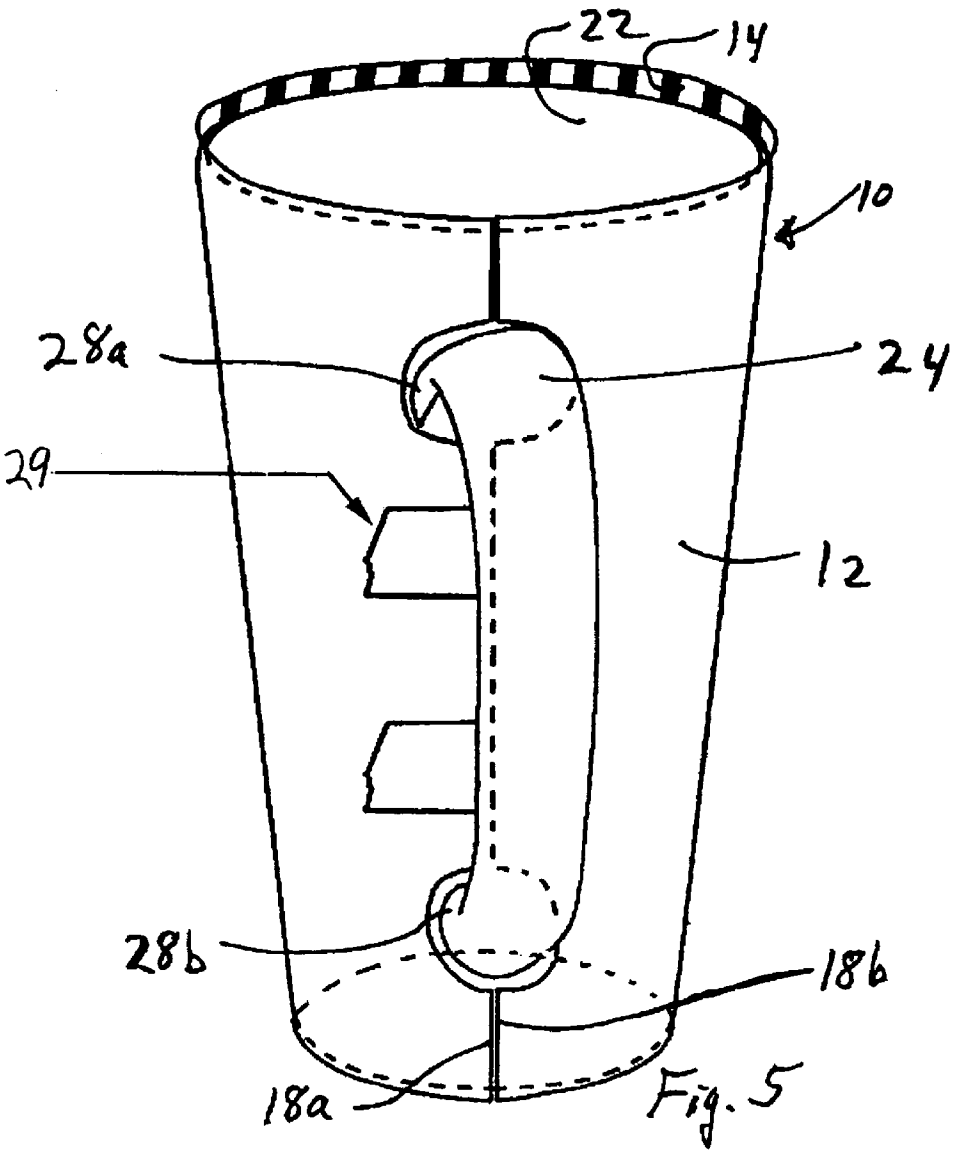
FIG. 5 shows the injected sublimation transfer paper of FIG. 3 placed around the mug of FIG. 2*a* and held together by adhesive tape.
Figure 6:
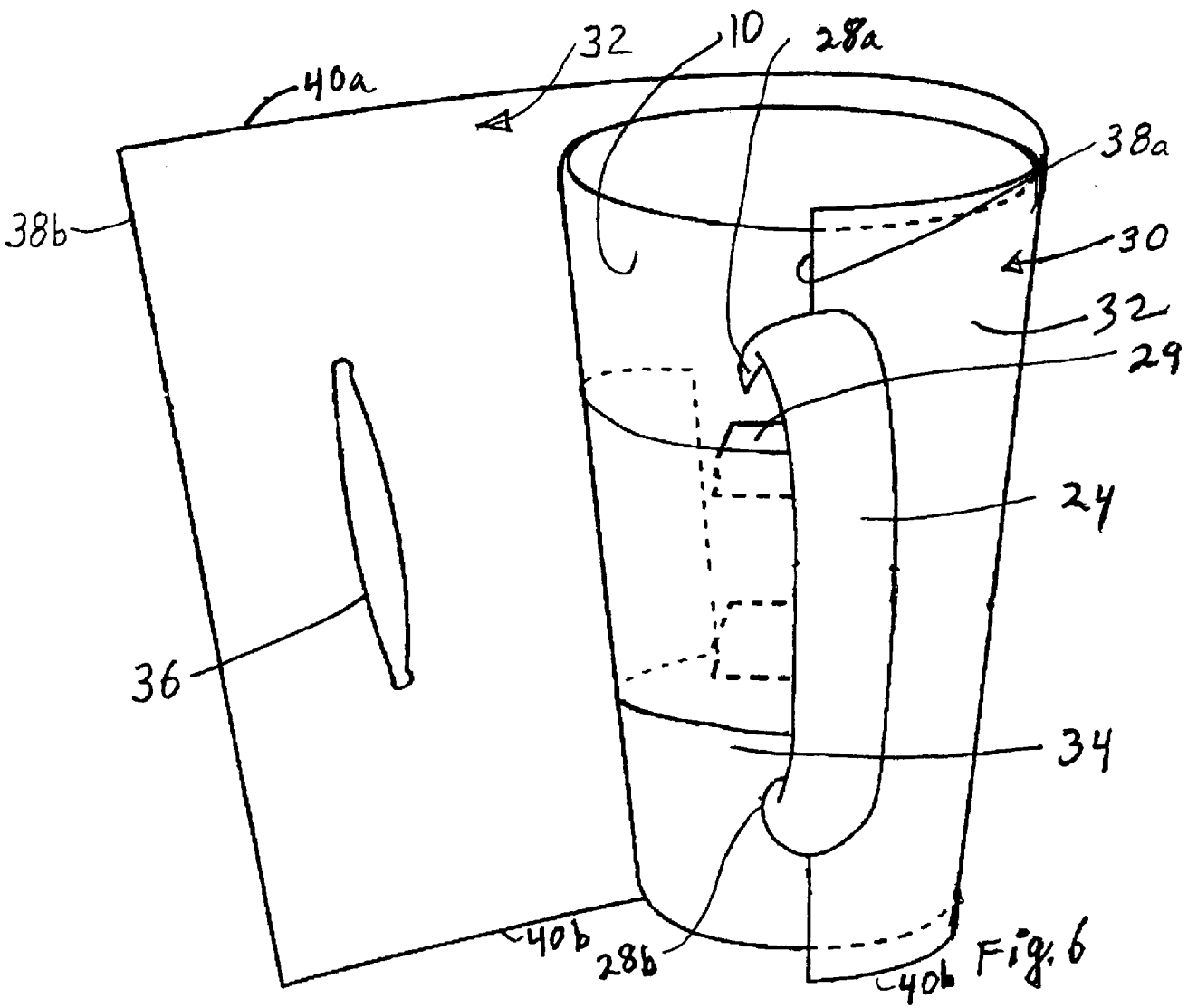
FIG. 6 shows the sublimation transfer clamp of FIG. 1*a* being placed around the mug of FIG. 2*a*, with a narrowed distal end of the clamp extending beneath the handle of the mug.

Referring to FIGS. 4-6, in use the sublimation transfer 10 is wrapped around container 22, and if needed temporarily held in place by adhesive tape 29. As best seen in FIGS. 4-5, the recesses 16 fit around the handle 22 at the connecting locations 28*a* and/or 28*b*, with the ends 18*a*, 18*b* abutting, adjacent, or overlapping beneath handle 24 and between the connecting locations 28*a*, 28*b*. The dye image 14 thus abuts the outer surface 26 of container 22. The clamp 30 is then placed to overlap the sublimation transfer 10 and stretched to resiliently urge the transfer 10 against the outer surface 26 of the container 22. The latching portion 34 is passed beneath the handle 24 and the body portion 32 and the end 38*a* positioned to abut the handle 24 at the connecting location(s) 28*a*, 28*b*. The end 38*a* in this embodiment does not extend substantially beneath the handle 24, although depending on how much the material of the clamp 30 stretches, a portion of the end 38*a* may extend beneath the handle. The latching portion 34 is wrapped around enough of the periphery of the sublimation transfer 10 so that it catches enough to allow the body portion 32 to be stretched. The body portion 32 is wrapped around the outside of the sublimation transfer 10, and if needed can be pressed against a distal end of the latching portion 34 to hold it in place and stretch the body portion 32. The elongated opening 36 is fit over the handle 24, and preferably stretched to fit over the handle.

Figure 7:
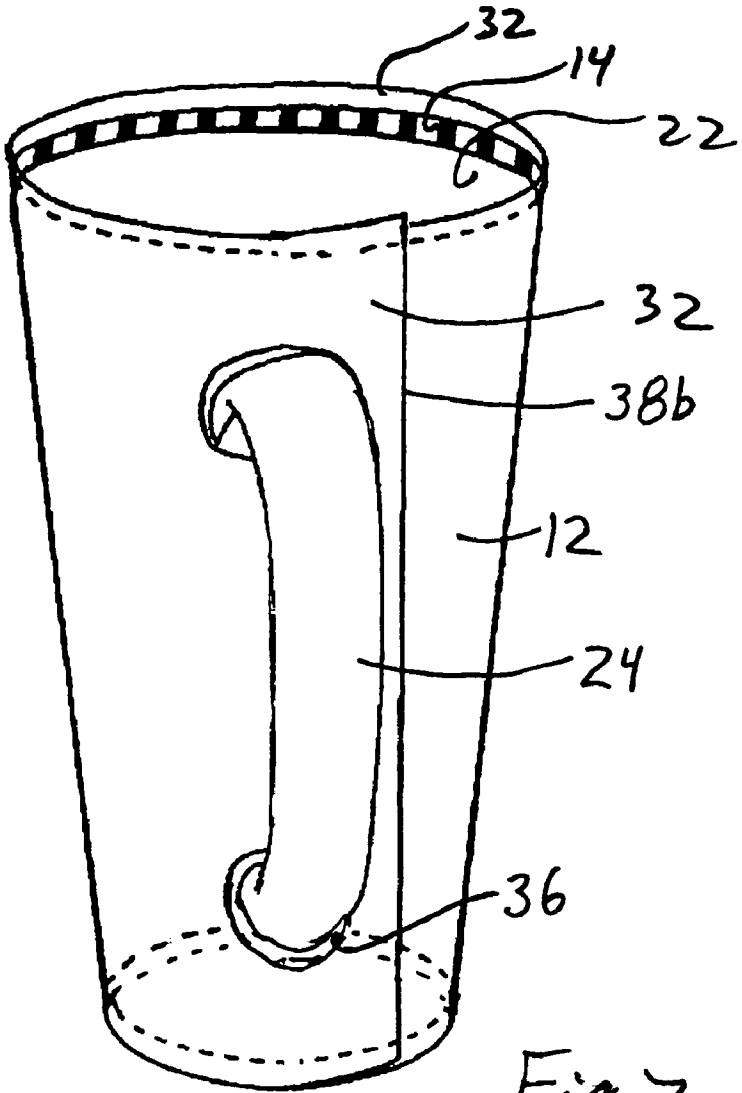
FIG. 7 shows the preferred embodiment of a clamp of FIG. 3 placed around the mug of FIG. 2*a;*
Figure 8:
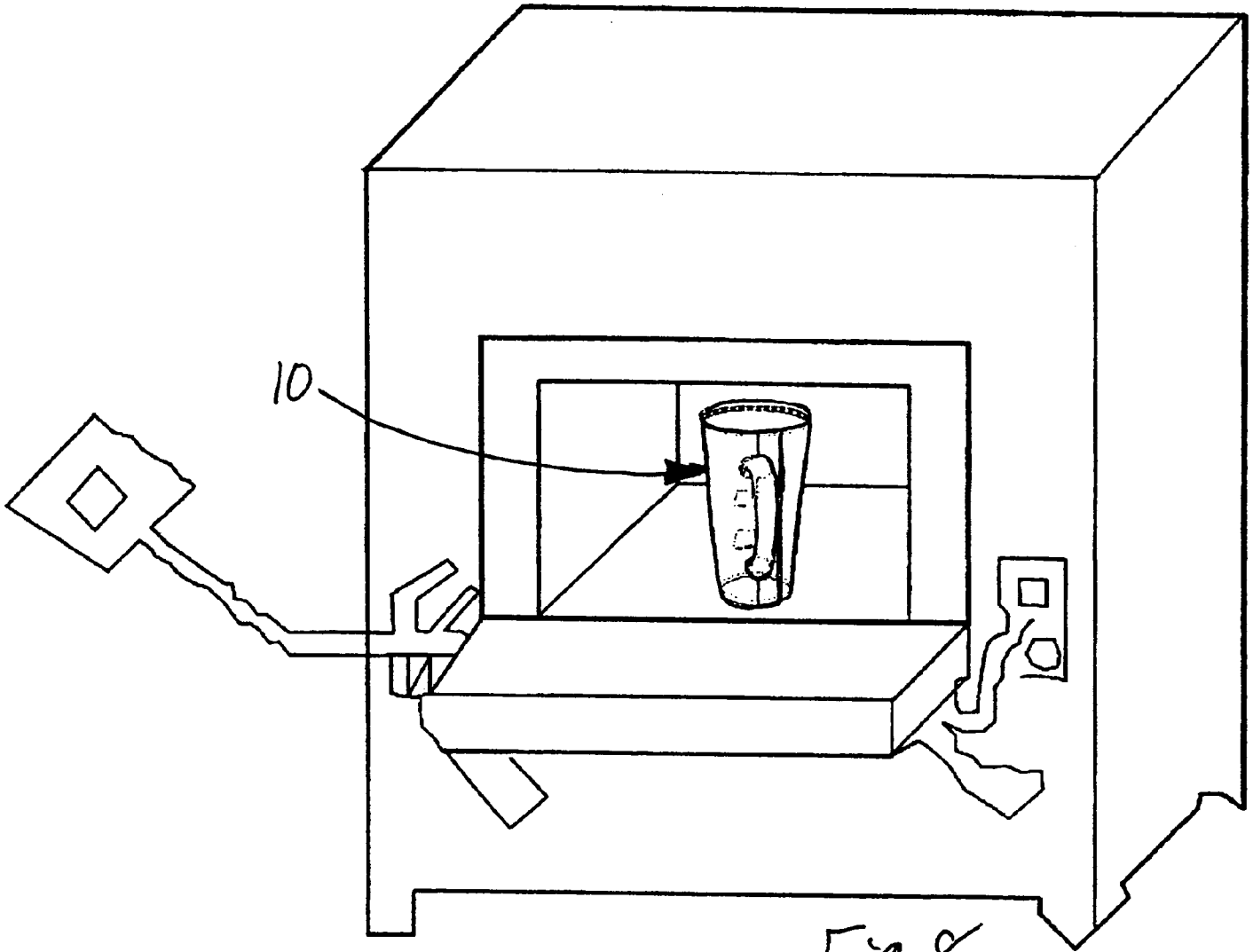
FIG. 8 shows the mug and clamp in an oven for causing transfer of the decal to the mug by heat.
Figure 9:
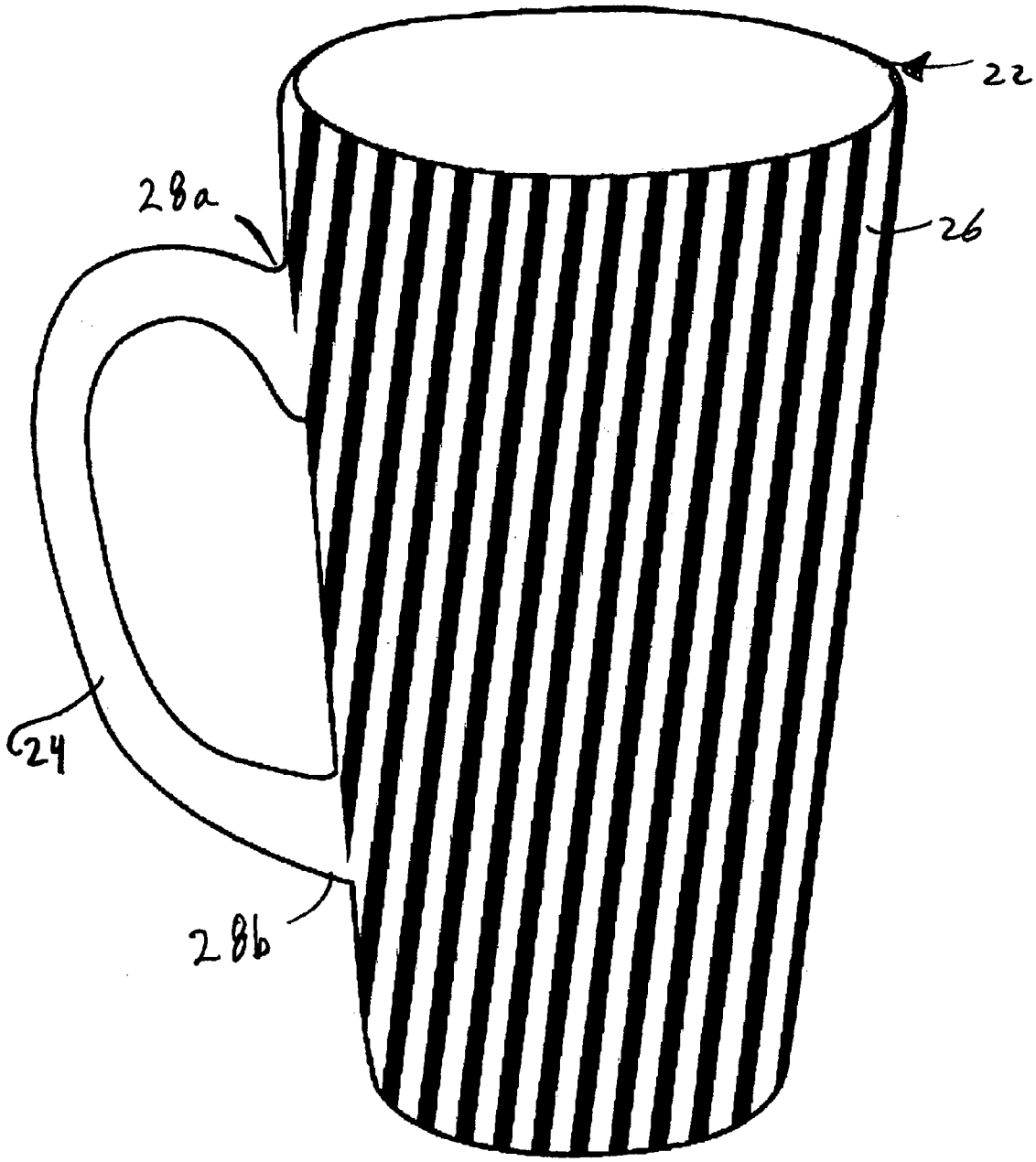
FIG. 9 show a printed mug produced in accordance with the instant invention.

Referring to FIGS. 7-8, the latching portion 34 thus fastens one end of the clamp 30 and the elongated opening 36 fastens the other end of clamp 30. The latching portion 34 and associated end 38*b* are located relative to elongated opening 36 so that the body portion 32 is stretched in order for the elongated opening 36 to fit over the handle 24. One end of the clamp 30, the latching portion 34 is held by frictional contact between the body portion 32 and sublimation transfer 10. The other end of the clamp 30 containing the elongated opening 36 is held by the handle 24, with the body portion being stretched between those two ends. The stretched portion of body 32 extends beneath handle 24, and optionally extends between the upper connection 28*a* and the top of the container 22, and also optionally extends between the lower connection 28*b* and the bottom of the container. The stretched body portion 30 squeezes the sublimation transfer layer 10 against the outer surface 26 of the container 30. The body portion 30 is preferably stretched enough so that the radial pressure between the dye image 14 and the outer surface 26 is sufficient to transfer the sublimation image to the outer surface 26 of the container 22, even at the location of the handle 24.

As shown in FIG. 6, the clamp 30 is designed to fit snugly around the container or mug 22 with the sublimation transfer 10 being squeezed between the clamp 30 and the mug 22. The cut-out recesses 16 in the sublimation transfer 10 and the elongated opening 36 in the clamp 30 enable the handle 24 to extend out through both the transfer 10 and the clamp 30 without interfering with the sublimation process.

Referring to FIG. 8, the entire assembly is then placed in an oven 46 which is operable to heat the subliminal transfer 12 and the container 22 sufficiently to cause the dye transfer onto the polymeric coating on the container by sublimation printing, thereby creating a desired image on the container. The oven 46 typically comprises an elongated chamber with a moving belt passing through the oven so that containers 22 are placed on the belt and remain in the oven a predetermined time before being automatically removed from the oven by movement of the belt. After the image transfer is complete, the clamp 30 is removed and can be reused, and the sublimation transfer 10 is removed and discarded. The completed container 22 bearing the image is then ready for use or sale, with the completed cup shown in FIG. 10. This allows the heating of plural containers 22 and sublimation layers 10 at the same time, without using a molded press configured for each container.

Referring to FIGS. 10-12, the sublimation layer 10 and clamp 30 may be used with other shaped containers 22. The illustrated container 22 comprises a mug having parallel sides rather than tapered sides, so the exterior surface 26 comprises a cylinder. While a handle 24 with two attachment locations 28*a*, 28*b* is shown, a single attachment location could be used, or more than two attachment locations could be used. The sublimation transfer 10 comprises a rectangular sheet having opposing long sides 20*a*, 20*b* and opposing ends 18*a*, 18*b*, with the length of the sides selected so the ends 18*a*, 18*b* abut or are in very close proximity when the transfer 10 is placed around the container 22. The image 14 is placed on one side of the sublimation transfer 10, and a suitable coating to accept the image is placed on the outer surface 26 of the container 10. Cutouts or recesses 16 are formed in the ends 18 to accommodate the attachment locations 18 of the handle 24.

FIG. 12 shows the clamp 30 for the mug 22 of FIG. 10 and sublimation transfer 10 of FIG. 11. The clamp 30 is again made of elastomeric or elastic material, including rubber but preferably silicon, with body portion 32 bounded by opposing sides 40*a*, 40*b*, and opposing ends 38*a*, 38*b*. The latching portion 34 extends from one side 38, and has a width W corresponding to the distance between sides 44*a*, 44*b*. Stress relief cut0outs 44 are formed at the corners as needed to reduce tearing of the clamp 30. Because the mug 22 is cylindrical the sides 40*a*, 40*b* are optionally parallel straight lines and perpendicular to ends 38*a*, 38*b*. A cut-out elongated opening 36 is formed in the body 32, preferably adjacent the end 38*b* opposite the latching portion 34. Since the handle 34 is vertical and the sides of the cup 22 are vertical and parallel, the elongated opening 36 is vertical and parallel to the ends 38*a*, 38*b*. Preferably, the distance between the elongated opening 36 and the end 38*a* is less than the circumference of the container 22 so that the body portion 32 encircles the container 22 one time and is stretched to align the elongated opening with the handle 24.

Figure 13A:
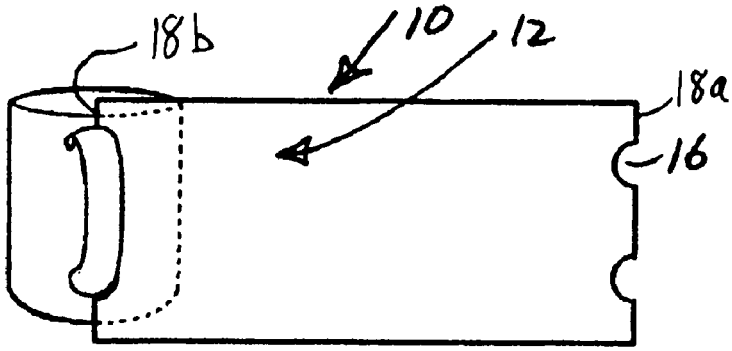
FIGS. 13*a*-13*c* are perspective views showing the sublimation layer of FIG. 11 applied to the mug of FIG. 10.
Figure 13B:
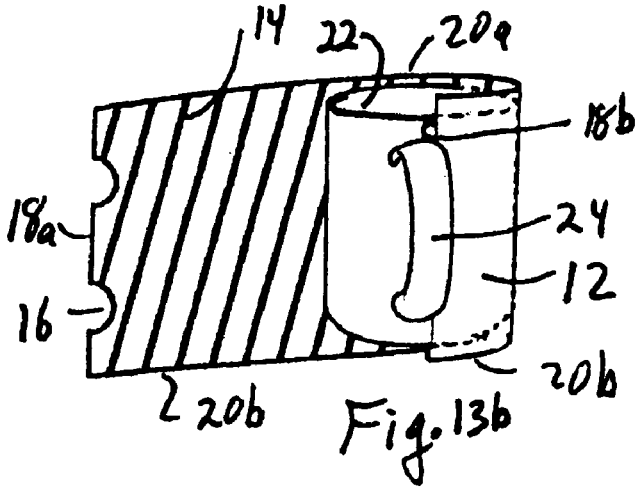
Figure 13C:
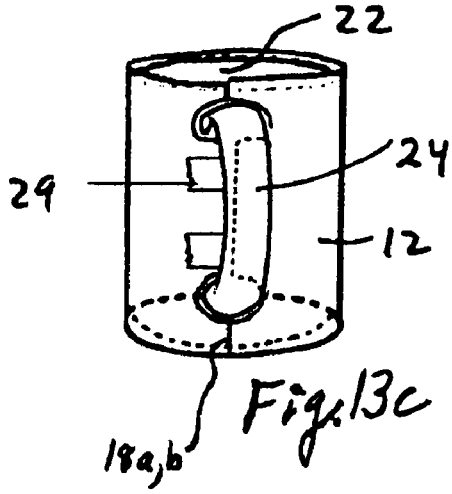

Referring to FIGS. 13*a*-13*b*, the sublimation transfer 10 is placed with end 18*b* and its recesses 16 abutting the handle 24 at the locations 28*a*, 28*b* where the handle joins the container 22. The sublimation transfer 10 is wrapped around the container 10 so the dye layer 14 abuts the receiving polymeric surface on outer surface 26 of the cup. The ends 18*a*, 18*b* abut each other and are optionally held together in abutting relationship by one or more pieces of tape 29 extending across the junction of the ends 28*a*, 28*b*. The tape 29 is shows being placed beneath the handle 24, but could be placed across the abutting ends 18*a*, 18*b* that are located above the juncture 28*a*, or below the juncture 28*b*, or the tape could be placed at all these locations or various combinations of these locations.

Figure 14A:
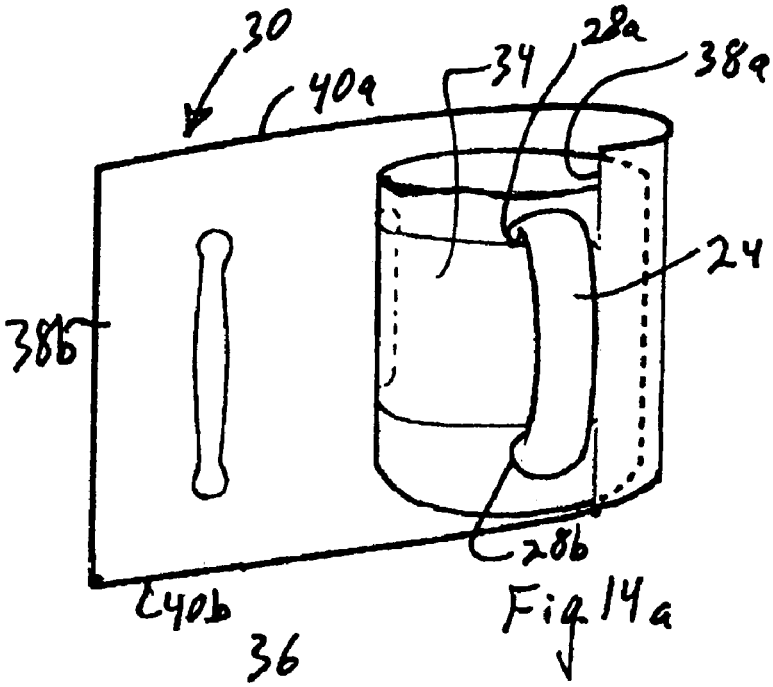
FIGS. 14*a*-14*c* are perspective views showing the clamp of FIG. 12 applied to the mug and sublimation layer of FIG. 13.
Figure 14B:
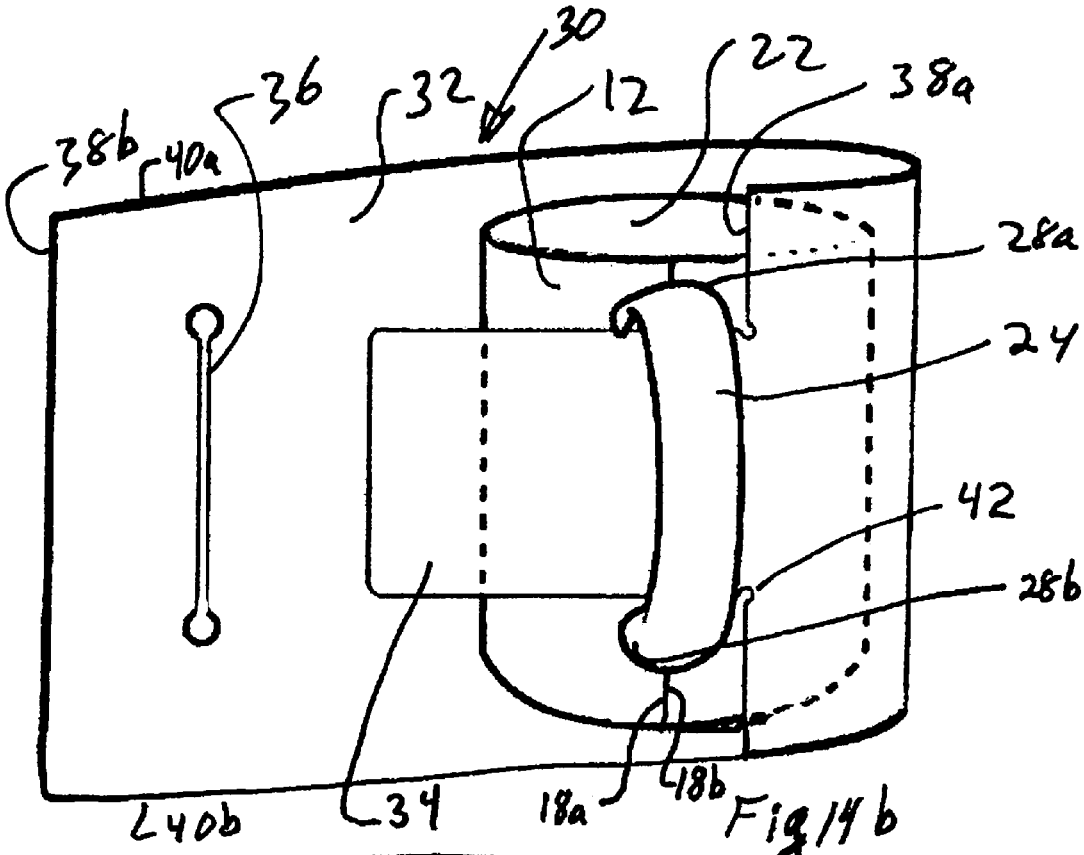
Figure 14C:
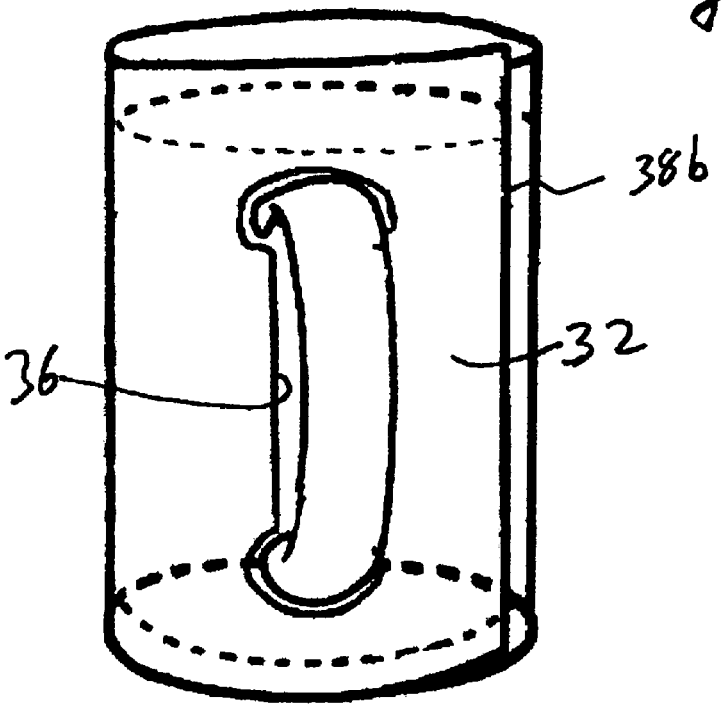

Referring to FIGS. 14*a*-14*c*, the clamp 30 is wrapped around the outside of the sublimation transfer 10 with the latching portion 34 extending beneath the handle 24 and wrapped around the transfer 10 until the clamp 30 can be stretched, with the cut-out 26 being stretched to fit over the handle 24 to hold the clamp in a stretched condition exerting inward pressure on the container 22, and when the container is a cone or cylinder the pressure is radially inward.

The clamped sublimation transfer 10 and container 22 are then heated so the sublimation transfer occurs and forms the image on the outer surface 26 of the container 22. An oven temperature of about 370-400° F. is believed suitable for the sublimation transfer to occur. As the temperatures increase, the risk of combustion increases. The material used for the sublimation transfer 10 and clamp 30 is selected to work within these desired temperatures. For a cup or mug 22 as described above, a conveyor oven which maintains the containers 22 in an oven heated to the above temperature for about 30 minutes is believed suitable to transfer the dye from the layer 14 to the outer surface 26 of the mug 22. After the mugs 22 exit the oven, the clamp 30 is removed by grabbing the end 38*b* and removing the elongated opening 36 from the handle 22, and unwrapping the elastic clamp 30. The clamp 30 can be reused. The sublimation transfer 10 is usually discarded.

In the above embodiments, the clamp 30 preferably stretches enough to apply an inward pressure sufficient to form a gas tight seal between the dye transfer 14 and the outer surface 26 of the container 22. A clamp 30 made of silicon material having a thickness of a few millimeters is believed suitable. The thickness and amount of stretch used will affect the radial clamping force, and the desirable force will vary with the size and shape of the container. The clamp 30 preferably has a width greater than that of the sublimation transfer 10, preferably about 0.5-1 inch larger on each side 40*a*, 40*b*. By making the width larger, the free edges of the sides 40*a*, 40*b* of clamp 30 are not stretched, while the portions of the clamp 30 abutting the rim and bottom of the mug 22 are stretched, and the difference in stretching causes the free edges to extend inward and that helps form a gas seal around the top and bottom of the container 10.

Because the latching portion 34 extends beneath the handle 24, it exerts a radially inward pressure on the ends 18*a*, 18*b* of the sublimation transfer 10 that are located beneath the handle. The clamp 30 extends around the entire periphery of the container 22 and exerts an inward pressure around the periphery and outer surface of the container 22.

The clamp 30 thus comprises an elastic sheet that encircles the outer surface 26 of the container 10 at least once, and passes beneath the handle once, to apply an inward pressure sufficient to form a gas seal suitable for sublimation transfer of layer 14 onto outer surface 26. This can be achieved by numerous variations on the above described clamp 30.

Figure 15:
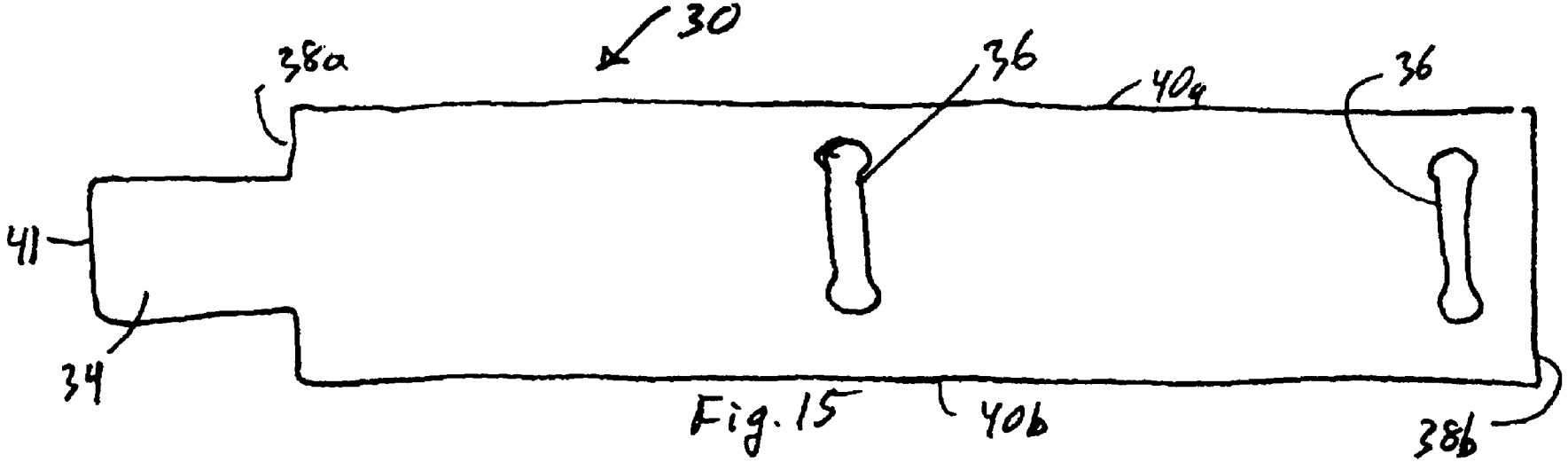
FIG. 15 is a plan view of a further embodiment of the clamp 30 having two slots.

Referring to FIG. 15, the clamp 30 could be formed with more than one elongated opening 36, so it can wrap more than one time around the outer surface of the container 22 with each elongated opening 36 fitting over the handle 24. The second wrap of the clamp 30 ensures that the area above and below the handle 24 are pushed radially inward sufficiently to achieve any dye transfer above and below the handles. These are the areas between juncture 28*a* and the top rim of the mug, and the area between juncture 28*b* and the bottom of the mug.

The above embodiments use an elongated opening 36 cooperating with the handle 24 to hold the exterior, distal end 38*b* of the clamp 30, while the interior distal end 34 is held by friction as it is gripped between the sublimation layer 10 and the body portion 32 of clamp 30. If desired, either or both ends of the clamp 30 could be fastened by other means, including adhesive tape, releasable adhesive applied to the clamp 30 or substrate 12, pins, pronged clamps, hook-and loop fasteners, and various other releasable fastening mechanisms. Indeed, the clamp 30 forms an elastic belt extending beneath the handle 24, and optionally extending above and below the handle as well to apply inward pressure urging the dye image 14 against the outer surface 26 of the cup 22.

Figures 16, 17A, 17B, 17C:
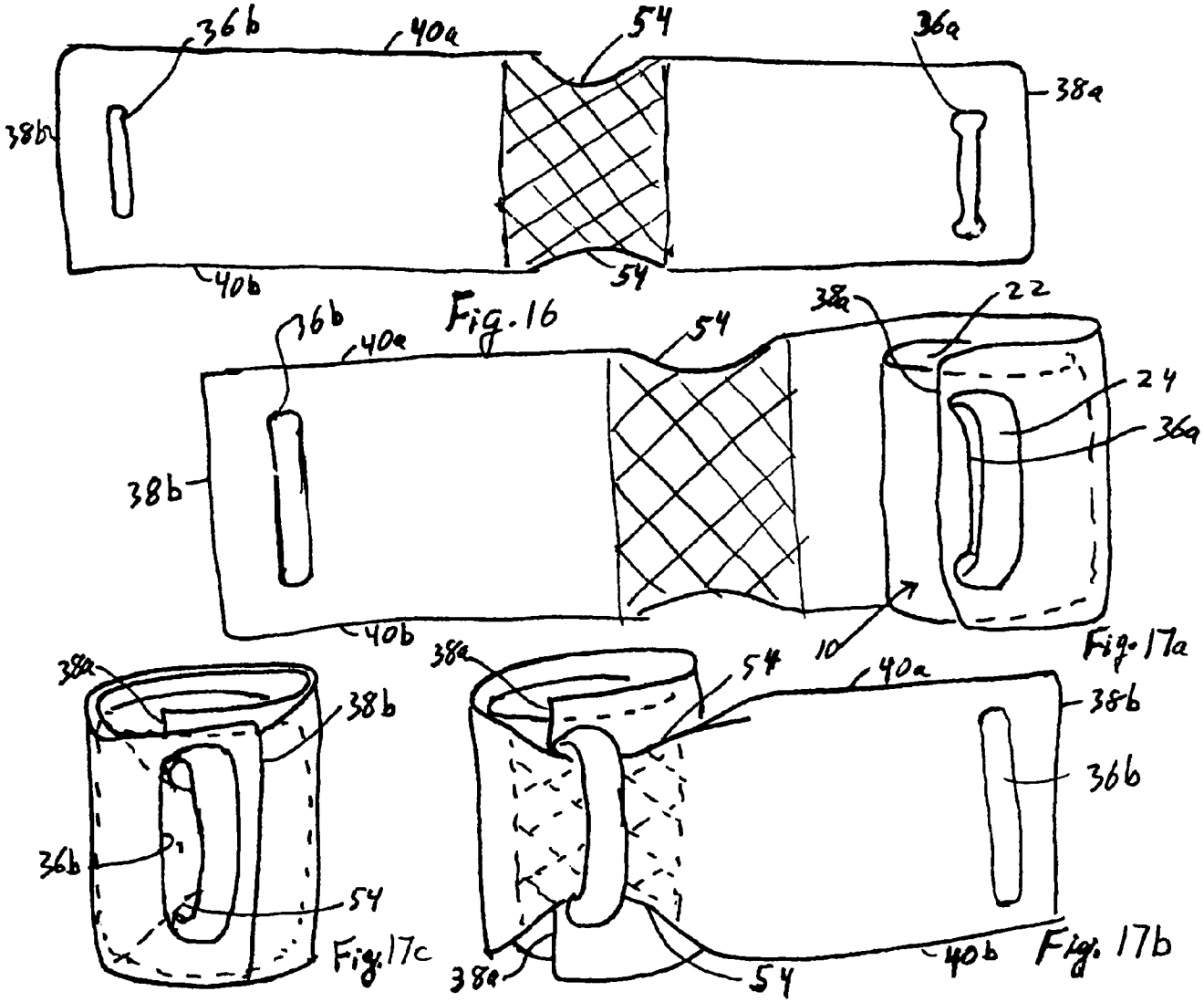
FIG. 16 is a plan view of a further embodiment of the clamp 30 having two slots and hooks.
Figures 18A, 18B:
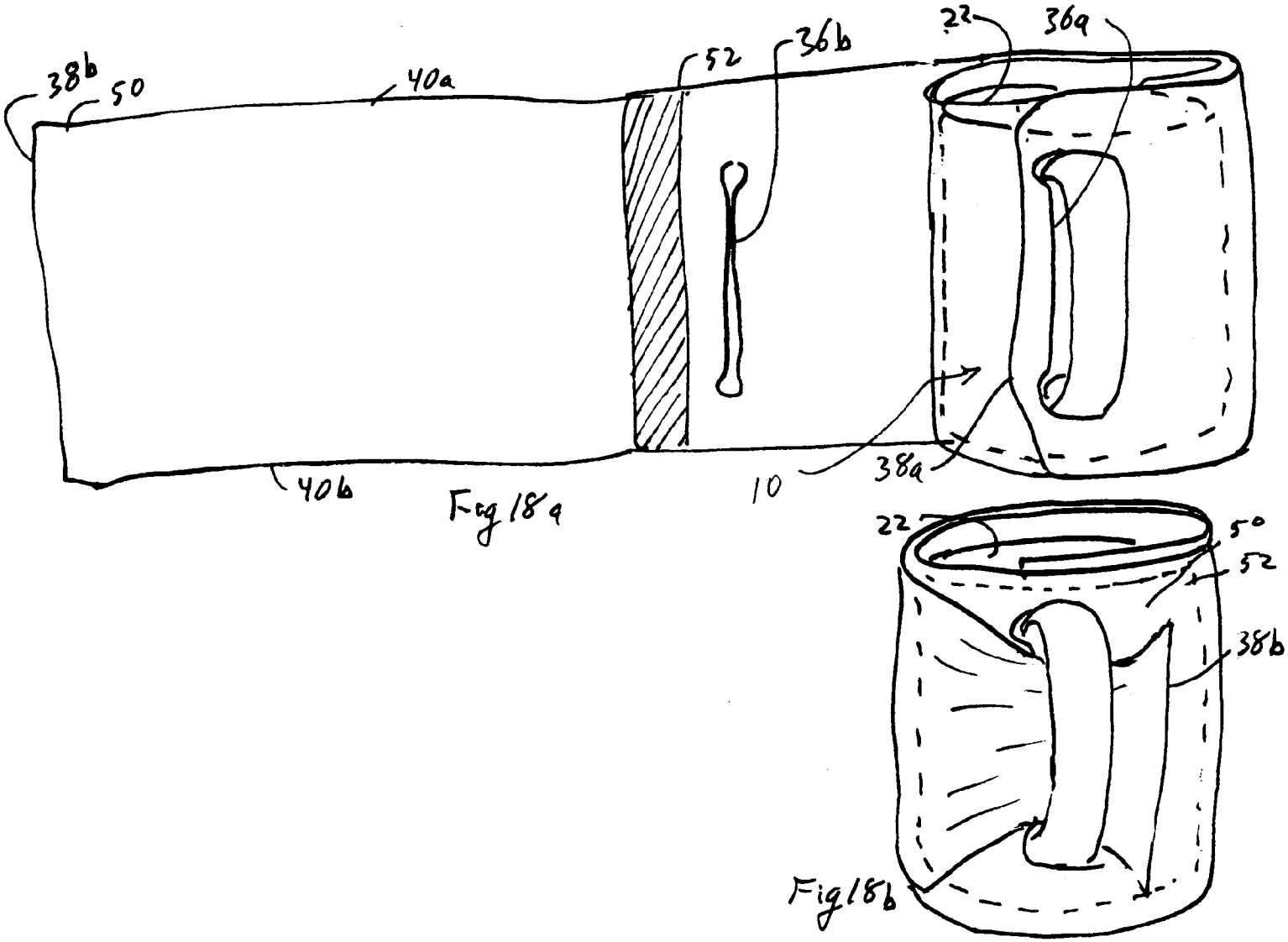

Referring to FIGS. 16-17, if the clamp 30 does not pass underneath the handle 24 initially, then each time the clamp 30 passes the handle a layer of material is interposed between the clamp 30 and the exterior surface of the substrate 12 which urges the dye layer 14 against the outer surface 26. Thus, the clamp 30 can have elongated opening 36*a*, 36*b* adjacent ends 28*a*, and 38*b*, respectively, with an optional necked down section 54 in between and located to pass beneath handle 24. The necked down section 54 is preferably narrower in width, but has an increased thickness. As seen in FIG. 17*a*, the first elongated opening 36*a* is passed over the handle 24 and the clamp 30 is stretched to apply inward pressure against the sublimation transfer 10. As the free end 38*b* passes beneath handle 24 it pulls the necked down portion 54 into position beneath the handle to complete the first wrap around the outside of the container 10. The increased thickness of the section 54 applies pressure to the ends 18*a*, 18*b* (FIG. 4*b*, 14*b*) of the sublimation transfer 10 located beneath the handle 24. The end 38*b* is then fastened to the body 30, or as illustrated, is fastened to the handle by wrapping the body 30 a second wrap around the container 10, so the elongated opening 36 passes over the handle 24 to prevent the stretched clamp 30 from unwrapping, as shown in FIG. 17*c*. The elongated opening 36*b* could be omitted and other fastening mechanisms could be used to connect the parts and maintain tension in the clamp 30 and thus maintain the inward pressure. If the elongated opening 36*b* is removed, the length of the depicted clamp could be shortened.

The shape of the slit, slot or cut-out portion forming the elongated opening 36 will vary depending on how much the material forming the clamp 30 will stretch without breaking, and depending on whether the elastic material defining the opening 36 is to exert any inward force on the area immediately adjacent the handle 24.

The use of a single elastic clamp 30 greatly increases the ease and speed of manufacturing while reducing the manufacturing cost. The elastic strip used for the clamp 30 is inexpensive compared to the cost of making a mold to clamp each cup individually. Further, a single elastic clamp 30 may be used on various shaped containers 30 to apply an inward pressure. There are advantages to having specially shaped clamps 30, and some containers may require a uniquely shaped clamp 30, but in general the clamps 30 can be used on various shaped or sized containers. Moreover, the ability to use a conveyor oven rather than individually heating each mug, cooling each mug sufficiently to remove it from the mold, increases manufacturing efficiency and reduces manufacturing costs.

Additionally, the resulting container or mug 22 is improved over prior art mugs 22 because the outer surface 26 located beneath the handle, at the abutting ends 18*a*, 18*b*, can be printed and printed to good quality as the pressure applied to the area beneath the handle can be varied by adjusting the tension applied to clamp 30. As the length of clamp 30 is decreased, it exerts an inward force and thus the inward pressure can be adjusted to achieve the desired pressure commensurate with the quality of sublimation transfer that is desired.

Further, shaping the clamp 30 to have a curved shape as in FIG. 1*a*, is believed to result in a clamp 30 that exerts primarily radially inward forces, and that helps prevent slippage of the dye image 14 during sublimation. Once the elastic clamp 30 is applied, the various parts are held in relative position, including the sublimation transfer 10 and outer surface 26, and that is believed to increase the quality of the image transfer to the mugs 22.

The above description is given by way of example, and not limitation. Given the above disclosure, one skilled in the art could devise variations that are within the scope and spirit of the invention disclosed herein, including various ways of fastening the opposing ends of the clamp 30, or of using various fastening methods in various combinations. For example, the one latching member 34 is shown, but more than one could be used on the end 38*b*, and each could be held in place by various (or different) fasteners or fastening mechanisms. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of applying a sublimation transfer to a container having a periphery with a handle, wherein the handle is connected to the container at least at one connection area on the outer surface of the container and extends along a portion of the container, the outer surface of the container coated with a polymeric coating, the method comprising:

placing a sublimation transfer around the container with a dye image of the sublimation transfer facing an outer surface of the container;

providing an elastic clamp comprising a sheet of elastomeric material that is stretched along a length of the material during use, the clamp having a first and second end joined by opposing sides and forming a body portion which is longer than a circumference of the container when the clamp is wrapped around the container, the clamp having at least one elongated opening adjacent one of the ends which opening is configured to allow the handle to pass through the opening, the opening having a closed periphery completely enclosed within the clamp before the wrapping step;

wrapping the clamp around the entire periphery of the outer surface of the container but beneath the handle and stretching the clamp along a length of the clamp an amount sufficient to increase the length of the clamp and cause the clamp to press the dye image inward against the outer surface of the container with a force sufficient to allow a sublimation transfer;

placing the opening over the handle;

applying heat to the wrapped sublimation transfer sufficient to cause a sublimation transfer of the dye image to the container.

2. The method of claim 1, further comprising:

fastening the first end of the clamp to at least one of the sublimation transfer, the clamp or the container before the wrapping step; and fastening the second end of the clamp to one of the clamp or the container.

3. The method of claim 1, wherein the step of placing the opening over the handle occurs after the wrapping step and fastens the second end to the container.

4. The method of claim 1, wherein the step of placing the opening over the handle occurs before the wrapping step.

5. The method of claim 1, wherein the body portion has a first width and a latching portion extending from the first end of the body portion with the opening located by the second end, and the wrapping step includes placing the latching portion beneath the handle and between the sublimation transfer and the clamp.

6. The method of claim 5, wherein the providing step includes the step of providing the elastic clamp having a rectangular configuration when laid flat.

7. The method of claim 5, wherein the container has inclined sides and the body portion comprises a segment of an arc having first and second opposing sides that are generally concentric.

8. The method of claim 7, wherein the latching portion comprises a segment of an arc having first and second opposing sides that are generally concentric.

9. The method of claim 5, further comprising:

providing stress relief openings at least at one of either the juncture of the latching portion and the body portion or on the opening.

10. The method of claim 5, wherein the handle fastens to the container at two locations and the latching portion passes between those locations and beneath the handle.

11. The method of claim 1, wherein the first end of the clamp is held between the sublimation transfer and the body portion of the clamp.

12. The method of claim 1, wherein the sublimation transfer has two ends which are placed in a contacting or very close to contacting position beneath the handle before the wrapping step.

13. The method of claim 1, wherein the wrapping step causes the clamp to encircle the outer surface of the container at least two times.

14. The method of claim 1, wherein the heat is applied to the wrapped sublimation transfer by placing the wrapped sublimation transfer on a conveyor of a conveyor oven, moving the convey and wrapped sublimation transfer into the conveyor oven, keeping the wrapped sublimation transfer in the oven a time sufficient to cause the sublimation transfer of the dye image to the container. and moving the conveyor and wrapped sublimation transfer from the oven, and further comprising:

removing the clamp and sublimation transfer.

15. A method of applying a sublimation transfer to a container having a periphery with a handle, wherein the handle is connected to the container at least at one connection area on the outer surface of the container and extends along a portion of the container, the outer surface of the container coated with a polymeric coating, the method comprising:

placing the sublimation transfer around the container with a dye image of the sublimation transfer facing an outer surface of the container;

providing a stretchable sheet of elastomeric material defining first and second ends of a body portion, the body portion having a length longer than the periphery of the container when the stretchable sheet of material is wrapped around the periphery of the container, the stretchable sheet of material having an opening adjacent the second end of the body portion, the opening configured to receive the handle of the container, the opening having a closed periphery entirely contained within the sheet of material before the wrapping step;

wrapping the stretchable sheet of material around the periphery of the container from a first point on the container periphery to a second point on the container periphery in a sequential manner;

during the wrapping step, stretching the stretchable sheet of material onto the container outer surface and the sublimation transfer to increase the length of the sheet of material to apply pressure to the outer surface of the container and the sublimation transfer with a force sufficient to allow a sublimation transfer;

traversing the handle of the container though the elongated opening to maintain the force caused by the wrapping and stretching steps when heat is applied to the sublimation transfer;

applying heat to the sublimation transfer to cause a sublimation transfer of the dye image to the container.

16. The method of claim 1, wherein the clamp is made of silicon elastomer.

17. The method of claim 15, wherein the sheet of elastomeric material is made of silicon elastomer.

18. The method of claim 1, wherein the container has a height and the distance between the opposing sides wound around at least a portion of the container is greater than the height.

19. A method of applying a sublimation transfer to a container having a periphery with a handle, wherein the handle is connected to the container at least at one connection area on the outer surface of the container and extends along a portion of the container, the outer surface of the container coated with a polymeric coating, the method comprising:

placing a sublimation transfer around the container with a dye image of the sublimation transfer facing an outer surface of the container;

providing an elastic clamp comprising a sheet of material with a first and second end joined by opposing sides and forming a body portion which is larger than the outer surface of the container when the clamp wraps around the container, the clamp having at least one elongated opening adjacent one of the ends which opening is configured to allow the handle to pass through the opening, the opening having a closed periphery which is contained completely within the elastic clamp before the wrapping step;

wrapping the clamp around the entire periphery of the outer surface of the container at least once but beneath the handle and stretching the clamp along a length of the clamp an amount sufficient to cause the clamp to press the dye image inward against the outer surface of the container with a force sufficient to allow a sublimation transfer;

placing the opening over the handle;

applying heat to the wrapped sublimation transfer sufficient to cause a sublimation transfer of the dye image to the container.

20. The method of claim 19, wherein the clamp is made of silicon, and further comprising:

fastening the first end of the clamp to at least one of the sublimation transfer, the clamp or the container before the wrapping step; and fastening the second end of the clamp to one of the clamp or the container.

21. The method of claim 19, wherein the step of placing the opening over the handle occurs after the wrapping step and fastens the second end to the container.

22. The method of claim 19, wherein the step of placing the opening over the handle occurs before the wrapping step.

* * * * *